US005287251A

United States Patent [19]

Kato

[11] Patent Number: 5,287,251

[45] Date of Patent: Feb. 15, 1994

[54] CONTROL PANEL

[75] Inventor: Tokichi Kato, Kanagawa, Japan

[73] Assignee: Marui Industry Co., Ltd., Kanagawa, Japan

[21] Appl. No.: 13,377

[22] Filed: Feb. 4, 1993

[30] Foreign Application Priority Data

Feb. 5, 1992 [JP] Japan ..... 4-010971[U]

[51] Int. Cl.[5] ..... F21V 33/00

[52] U.S. Cl. ..... 362/85; 362/24

[58] Field of Search ..... 362/85, 24

[56] References Cited

U.S. PATENT DOCUMENTS 5,130,897 7/1992 Kuzma ..... 362/24

FOREIGN PATENT DOCUMENTS 62-203691 9/1987 Japan .

3-23915 3/1991 Japan .

4-22389 5/1992 Japan .

2060971 5/1981 United Kingdom ..... 362/85

*Primary Examiner*—Carroll B. Dority

*Attorney, Agent, or Firm*—Wenderoth, Lind & Ponack

[57] ABSTRACT

A control panel includes a cover plate and at least one cap-shaped control key or button. The key includes a cap-shaped plastic substrate the side wall of which includes a light-block cylindrical portion for preventing light from leaking out through the side wall, even if the light-block coating formed on the outer surface of the side wall is not sufficient.

2 Claims, 1 Drawing Sheet

CONTROL PANEL

FIELD OF THE INVENTION

This invention relates to a control or operation panel for various apparatuses such as a control panel in front of a driver's seat in an automobile, the panel including a cover or front plate and at least one control key or button for operating an electrical circuit installed behind the cover plate, in particular, to a control panel wherein, when the key is actuated, a light set behind the cover plate is turned on to illuminate the key from the inside of the control panel so as to light up the operation indicating sign formed on the front surface of the key.

BACKGROUND OF THE INVENTION

Generally, the elements of such a control panel, i.e., a cover plate and keys, each include a plastic substrate and a light-blocking coating formed on the outer surfaces thereof. The coating on the key is treated by, for example, laser beam so as to form an operation indicating sign for indicating the operation effected by operation of the key. In order to make the color tone of the entire outer surface of the control panel uniform, the coatings formed on the surfaces of the cover plate and keys are formed from the same material. It often occurs, however, that since these elements are generally formed separately and then assembled together, the color tone of the coatings of these elements slightly differs from each other.

Further, when a control panel is assembled in such a manner, the keys are prone to being set in incorrect positions in the cover plate.

Furthermore, if it is attempted to first assemble the plastic substrates of the elements and then to form coatings on the surfaces of the substrates, it is difficult to uniformly form the coatings on all of the surfaces, because, for example, the keys generally have a front surface parallel to the surface of the cover plate and side surfaces generally normal to the front surface, thereby causing slight leakage from the side surfaces, on which the coating is not sufficiently formed, when the key is actuated and the light behind the cover plate is turned on.

SUMMARY OF THE INVENTION

An object of this invention is, therefore, to provide a control panel which does not have the defects stated above.

To achieve this object, a control panel in accordance with this invention includes a cover plate and at least one cap-shaped control key or button, the key including a cap-shaped plastic substrate the side wall of which includes a light-blocking cylindrical portion for preventing light from leaking out through the side wall, even if the light block coating formed on the outer surface of the side wall is not sufficient, whereby it becomes possible to form the control panel by assembling the cover plate and the key and then forming light-block coatings on the outer surfaces thereof.

DETAILED DESCRIPTION OF A PREFERRED EMBODIMENT

Figure 5:
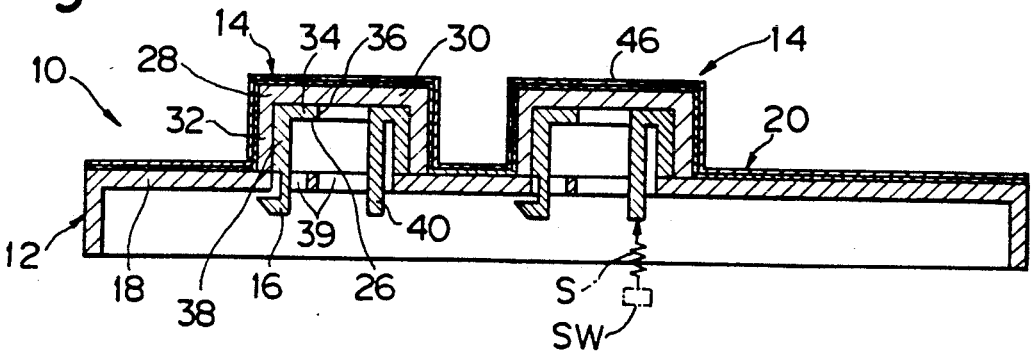

As shown in FIG. 5, a control panel 10 in accordance with a preferred embodiment of this invention includes a cover plate 12 and a plurality of keys or cap-shaped push buttons 14 (in the figures, only two cap-shaped control keys are shown) which are movably provided on the cover plate. When the control panel is assembled over the electrical circuit means not shown, the keys are urged upwards by spring means S provided between the keys 14 and the corresponding electrical switch means SW, and retained by the engagement of the retention projections 16 of the keys with the inner surface of the cover plate so that an operator operates the keys by depressing them. When the key is depressed so as to turn on the corresponding switch, the corresponding lights (not shown) installed inside the control panel are turned on to illuminate the keys 14 from the inside thereof.

The cover plate 12 includes a plastic substrate 18 having a light-block coating 20 formed on the surface of the substrate. The coating includes two films: one is a light-transmittal color film 22, in this particular embodiment, white color film provided directly on the outer surface of the substrate of the cover plate, and the other is a light-block film 24 provided on the first film, in this particular embodiment, black film.

The key 14 includes a generally cap-like shaped plastic substrate consisting of inner and outer parts 26, 28: the outer part 28 is made from transparent plastic and is of the shape of a cap, having a top wall 30 and a side wall 32; and the inner part 26 is made from black light-block plastic and is of the shape of a cap, having a top wall 34 with an opening 36 and a side wall 38 with a retention projection 16 which extends through the opening 39 provided in the cover plate and is adapted to be engaged with the inner surface of the cover plate substrate 18. The inner part 26 further includes a projection 40 which extends from the inner surface of the top wall 30 and passes through the opening 39 provided in the cover plate 12 so as to provide the spring means S between the projection 40 and the electrical switch means SW. The key 14 further includes a light-block coating formed on the outer surface of the cap-shaped substrate, the coating consisting of the same films 22, 24 as those of the cover plate, i.e., one is a light-transmittal white color inner film 22 and the other is a light-block black outer film 24. The light-block outer film 22 on the top surface of the cap-shaped substrate is partly removed to form a predetermined indicating sign 46 which allows the light illuminated from the backside of the key, so that a white color sign appears on the top surface.

FIGS. 1–4 show the process for producing the control panel.

Figure 1:
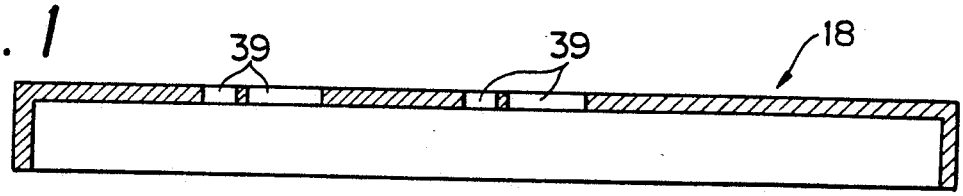
FIG. 1 is a sectional view of the plastic substrate of a cover plate.
Figure 2:
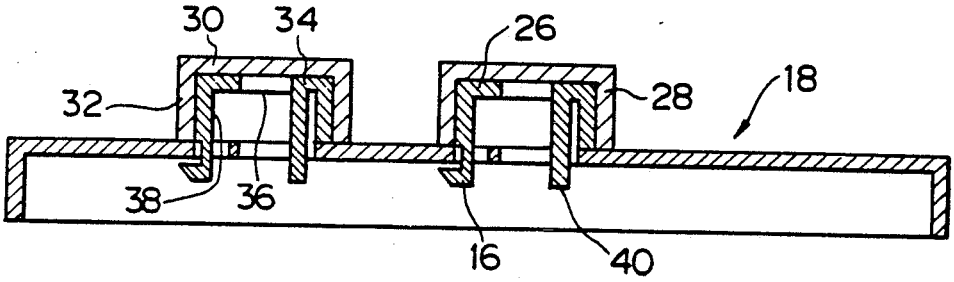
FIG. 2 is a similar sectional view of the substrate of the cover plate on which the plastic substrates of keys are mounted.
Figure 3:
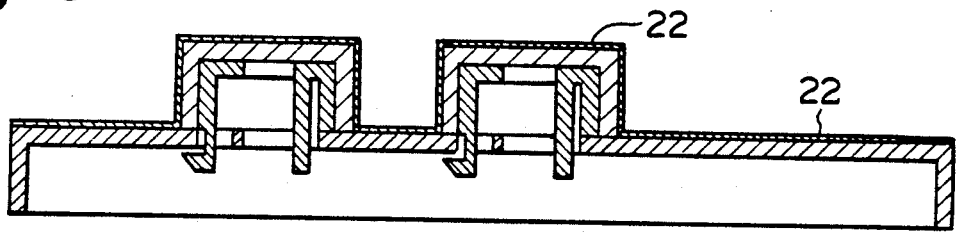
FIG. 3 is a sectional view similar to FIG. 2, in which light-transmittal color coating films are provided on the outer surfaces of the substrates of the cover plate and keys.
Figure 4:
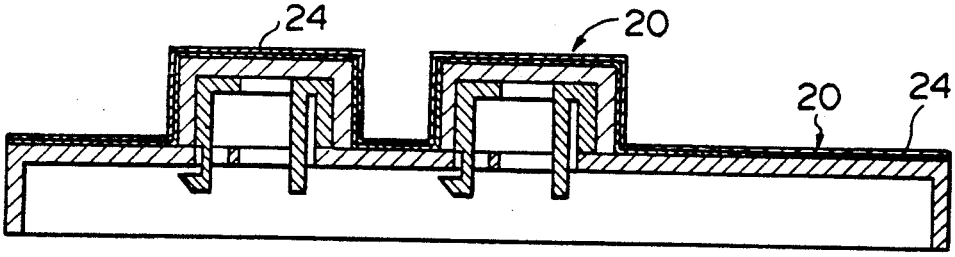
FIG. 4 is a sectional view similar to FIG. 3, in which light-block coating films are provided on the light transmittal color films; and, FIG. 5 is a sectional view similar to FIG. 4, in which a part of the light-block film is removed by laser beams to form an operation indicating sign.

According to the process, the substrate of the cover plate and the substrates of the keys are first prepared and then these elements are assembled as shown in FIG. 2.

Thereafter, the inner light-transmittal white films 22 are formed on the outer surfaces of these substrates and then the outer light-block films 24 are formed on the inner films.

In this invention, the coatings of the cover plate and the keys are simultaneously formed by, for example, spraying color paint under the same atmosphere and, therefore, the color tone of the coatings on the cover plate and keys become the same. Further, since the key includes light-block means in the side wall of the substrate thereof, even if the light-block coating on the side wall of the key is insufficient, light leakage through the side wall can be prevented.

What is claimed is:

1. A control panel including a cover plate and at least one cap-shaped control key or button which is movable on the cover plate to operate an electrical circuit installed behind the cover plate, in which, when the key is actuated, a light set behind the key is turned on to illuminate the key from the backside thereof so as to light up an indication sign formed on the front surface of the key, said cover plate including a plastic substrate having at least one opening and a light-block coating formed on the surface of the substrate, said key including a cap-shaped plastic substrate and a light-block coating formed on the outer surface of the generally cap-like shaped substrate, the light-block coating on the top surface of the cap-shaped substrate being partly removed to form said indication sign which permits the light illuminated from the backside of the key to pass therethrough, the side wall of the cap-shaped substrate including a light-block cylindrical portion for preventing the light from leaking out through the side wall.

2. A control panel of claim 1 in which said substrate of the key includes an outer part and an inner part, said outer part being of the shape of a cap having a top wall and a cylindrical side wall, said inner part including a cylindrical wall which is fit inside the side wall of the outer part to form said light-block cylindrical portion.

* * * * *